US006241345B1

(12) United States Patent
Ushioda

(10) Patent No.: US 6,241,345 B1
(45) Date of Patent: Jun. 5, 2001

(54) INK JET RECORDING HEAD CONTROLLING DIAMETER OF AN INK DROPLET

(75) Inventor: Toyoji Ushioda, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/221,141

(22) Filed: Dec. 28, 1998

(30) Foreign Application Priority Data

Dec. 26, 1997 (JP) ..... 9-366923

(51) Int. Cl.[7] ..... B41J 29/38; B41J 2/045

(52) U.S. Cl. ..... 347/68; 347/10; 347/11; 347/70

(58) Field of Search ..... 347/68, 10, 11, 347/69–71

(56) References Cited

U.S. PATENT DOCUMENTS

| | | | | |
|---|---|---|---|---|
| 4,106,032 | | 8/1978 | Miura et al. | 346/140 R |
| 4,339,763 | | 7/1982 | Kyser et al. | 346/140 |
| 4,561,025 | | 12/1985 | Tsuzuki | 358/298 |
| 5,406,318 | | 4/1995 | Moore et al. | 347/70 |
| 5,424,769 | * | 6/1995 | Sakai et al. | 347/68 |
| 5,510,816 | * | 4/1996 | Hosono et al. | 347/10 |
| 5,631,675 | * | 5/1997 | Futagawa | 347/68 |

FOREIGN PATENT DOCUMENTS

| | | |
|---|---|---|
| 194 852 | 9/1986 | (EP) . |
| 277 703 | 8/1988 | (EP) . |
| 608 835 | 8/1994 | (EP) . |
| 608 879 | 8/1994 | (EP) . |
| 648 606 | 4/1995 | (EP) . |
| 51-37541 | 3/1976 | (JP) . |
| 54-97427 | 8/1979 | (JP) . |
| 60-125675 | 7/1985 | (JP) . |
| 61-100469 | 5/1986 | (JP) . |
| 62-174163 | 7/1987 | (JP) . |
| 2192947 | 7/1990 | (JP) . |
| 6-297707 | 10/1994 | (JP) . |
| 6316074 | 11/1994 | (JP) . |
| 8267739 | 10/1996 | (JP) . |
| 8336970 | 12/1996 | (JP) . |
| 10296971 | 11/1998 | (JP) . |
| 1191143 | 4/1999 | (JP) . |
| 11157064 | 6/1999 | (JP) . |
| 94/26522 | 11/1994 | (WO) . |

OTHER PUBLICATIONS

T. Ushioda et al., "NEC Research & Development" No. 84, *High Resolution Printing with Drop–On–Demand Jet Head*, pp. 14–41, (Jan. 1987).

"Journal of Electrophotographic Institute", vol. 26–1, pp. 2–10, (Mar. 1987).

* cited by examiner

*Primary Examiner*—John Barlow
*Assistant Examiner*—An H. Do
(74) *Attorney, Agent, or Firm*—Foley & Lardner

(57) ABSTRACT

An ink jet recording head has a plurality of pressure chambers each driven by a piezoelectric element for ejection of ink droplets having different diameters from a nozzle. The drive voltage for the piezoelectric element has a controlled rise-time, controlled pulse period, and a controlled fall-time for ejecting ink droplets having different diameters and a constant velocity.

17 Claims, 15 Drawing Sheets

INK JET RECORDING HEAD CONTROLLING DIAMETER OF AN INK DROPLET

BACKGROUND OF THE INVENTION (a) Field of the Invention

The present invention relates to an ink jet recording head capable of controlling the diameter of an ink droplet ejected from the ink jet recording head to record a gray scale image. The present invention also relates to a method for controlling the diameter of an ink droplet in an inkjet recording head.

(b) Description of the Related Art

A drop-on-demand ink jet printer ejects ink droplets from ink nozzles of an ink jet recording head only when the ink droplets are requested. Specifically, the ink droplet is ejected from the ink nozzle by impressing a drive voltage to the piezoelectric element to generate a pressure wave in the ink chamber.

On the other hand, a stemmed ink jet recording head, such as proposed in Patent Publication JP-B-49(1974)-9622 for example, ejects ink droplets having variable diameters onto a recording sheet to thereby print a gray scale image such as for photographic data.

FIG. 1 shows a cross section of a conventional ink jet recording head, described in JP-A-51-37541, wherein a combination of a piezoelectric element 185 and a diaphragm 184 generates a pressure wave in a pressure chamber 182 of the ink jet recording head 180 receiving therein liquid ink. The pressure wave is transferred to a first nozzle 181, where the liquid ink in the ink supply chamber 183 is ejected from a second nozzle 186 due to the pressure wave while forming an ink droplet 188.

FIGS. 2A and 2B show examples of dot patterns formed by the conventional ink jet recording head 180, wherein a single pixel is formed by a matrix of N×N dots 151. In FIG. 2A, the gray scale image is represented by the arrangement of a plurality of dots 151 marked in the matrix, with the diameter of the dots 151 being constant. In this configuration, the number L1 of gray scale levels are expressed by:

$$L1=N^2. \tag{1}$$

A higher resolution and a larger number of gray scale levels, such as for a photographic image, require a larger number (N) of dots 151 for the matrix (or larger matrix size N) in FIG. 2A. The larger matrix size N also requires a higher resolution for the dot itself due to reduction in the resolution for each pixel.

On the other hand, if the dots have variable dot diameters, such as shown in FIG. 2B, the dots by themselves provide gray scale levels. Specifically, assuming that the number of gray scale levels for each dot is n, the number L2 of gray scale levels in FIG. 2B can be expressed by:

$$L2=n\times N^2 \tag{2}$$

In the dot pattern of FIG. 2A, wherein n=1 in equation (2) due to the constant diameter of the dots 151 and N=3 for the matrix size, the number L2 of gray scale levels obtained from equation (2)) is L2=9. On the other hand, in the dot pattern of FIG. 2B wherein n=4 in equation (2)) due to the four levels of the variable dot diameters (151*a*, 151*b*, 151*c* and 151*d*) and N=3, the number L2 of gray scale levels obtained from equation (2) is L2=36, which is far greater compared to FIG. 2A, whereas the resolution for each pixel in FIG. 2B is not degraded. In short, the variable dot diameter pattern shown in FIG. 2B can increase the number of gray scale levels for the dot pattern without raising the dot resolution.

The control of the dot diameter can be achieved by the amount Q of ink for each ink droplet. The amount Q is expressed by:

$$Z\ \tau\times v\times A. \tag{3}$$

wherein τ, v and A are wave motion period of the pressure wave generated in the pressure chamber 182, velocity of the ejected ink droplet and the sectional area of the second nozzle 186, respectively. The velocity (v) of the ink droplet and drive voltage V applied to the piezoelectric element 185 have the following relationship:

$$v\ V. \tag{4}$$

FIG. 3 shows exemplified pressure response characteristics of the ink in the pressure chamber 182, wherein the peak pressure of the ink in the pressure chamber 182 changes Pa to Pd based on the applied voltages V.

The velocity v of the ejected ink droplet changes based on the pressure, and thus based on the applied voltage, whereas the wave motion period τ does not change. Accordingly, the following relationship:

$$Q\ V \tag{5}$$

can be obtained from relationship (3).

In the ink jet recording head shown in FIG. 1, the voltage V applied to the piezoelectric element 185 is changed so as to control the pressure of ink in the pressure chamber 182, whereby the amount Q of the ink in the ink droplet ejected from the second nozzle 186 is controlled.

It is noted that the change of the velocity v of the ejected ink droplet affects the image quality of the conventional ink jet recording head. This is caused by deviation of the position at which the ink droplet reaches the recording sheet due to the variations of the ratio of the relative velocity between the recording head and the recording sheet to the velocity of the ejected ink droplet.

In addition, when a small ink droplet is ejected, the small ink droplet generally has a lower velocity and tends to stay in the vicinity of the second nozzle, causing stains in the ink jet recording device. This problem may be solved by a recording head proposed in JP-A-51-37541, wherein an air passage 189 is provided outside the pressure chamber 182 and a third nozzle 190 is additionally provided in front of the second nozzle 186, as shown in FIG. 1.

In the illustrated example, an airflow 191 flowing out of the third nozzle 190 at a constant velocity is generated by an air pump or an air accumulator installed outside the ink jet recording head 180. The ink droplets 188 ejected from the second nozzle 186 are lead by the airflow 191, whereby any ink droplet has a velocity equivalent to the velocity of the air flow 191. This proposal may solve the problem as described above. However, the proposed ink jet recording head has larger size, complicated structure and larger weight due to provision of the air passage 189 and the air pump or accumulator.

In an alternative of the above proposal, another ink jet recording head is proposed in JP-A-61-100469, wherein it is noted that the wave motion period of the pressure wave is acoustic and inherent to the pressure chamber.

Specifically, it is noted that the amount Q of the ink in the ejected ink droplet can be controlled based on the natural period τ of the ink pressure wave while maintaining the velocity v of the ink droplet at a constant. To obtain different diameters for the ink droplets, a plurality of ink passages having different natural periods are provided in the ink jet recording head, wherein different nozzles eject respective ink droplets having different diameters. The proposed ink jet recording head has, however, drawbacks of increased head size and higher fabrication costs.

Another drop-on-demand ink jet recording head, proposed in JP-A-62-174163, has a configuration wherein one or each of a plurality of piezoelectric elements is attached to the location corresponding to the belly portion between adjacent nodes of one of waves of the natural oscillation modes of the ink in the ink passage. The piezoelectric element thus located is driven to generate a corresponding oscillation mode.

FIG. 4A shows the configuration proposed in JP-A-62-174163 as mentioned above, wherein the piezoelectric element 172 (shown by a dotted line) is located within an ink passage 171 at the location corresponding to the belly portion sandwiched between adjacent nodes of the wave of the tertiary natural oscillation mode, and FIG. 4B shows the wave of the tertiary natural oscillation mode of the ink in the ink passage 171.

The length of the piezoelectric element 172 is designed equal to the length of the portion of the ink passage 171 corresponding to the belly portion between adjacent nodes of the tertiary natural oscillation mode, and the piezoelectric element 172 is located at the belly portion 175 between these adjacent nodes 176 and 177.

The piezoelectric element 172 is driven by a drive voltage having a waveform corresponding to the tertiary natural oscillation mode, to generate a pressure wave having the tertiary oscillation mode in the ink in the ink passage 171. Thus, the pressure wave having a relatively small wavelength can eject a small ink droplet.

A quartic or higher-order natural oscillation mode can be also obtained by attaching a plurality of piezoelectric elements to the locations corresponding to the bellies of the quartic or higher-order natural oscillation mode, and driving the attached piezoelectric elements by a drive voltage having a waveform corresponding to the natural period.

The ink jet recording head thus proposed is generally suited to generate a fundamental oscillation mode and an additional higher-order oscillation mode corresponding to the location of the piezoelectric element or locations of the piezoelectric elements. That is, the proposed recording head can eject only ink droplets having two different diameters corresponding to the fundamental mode and the higher-order mode. Thus, it is not suited to print a gray scale image having a larger number of gray scale levels, such as for photographic image.

Some other recording heads eject a plurality of smaller size ink droplets at a single position, whereby a plurality of gray scale levels are obtained by selecting the number of the ink droplets ejected at the single position. In this configuration, however, a high-speed printing is not achieved due to the iterated ejection of the ink droplets at the single position.

SUMMARY OF THE INVENTION

It is an object of the present invention to provide an ink jet recording head capable of controlling the diameter of an ink droplet and suitable for printing gray scale images in a full-color printing.

It is another object of the present invention to provide a method for controlling the diameter of an ink droplet in an ink jet recording head.

The present invention provides an ink jet recording head comprising a plurality of pressure chambers each for receiving therein ink, each of the pressure chambers having a movable wall and a fundamental period of the ink in the pressure chamber, an ink nozzle disposed for each of the pressure chambers for ejecting the ink in the pressure chamber as an ink droplet, an ink inlet port for receiving the ink to each of the pressure chambers, a piezoelectric element disposed in association with each the movable wall for responding to a drive pulse having a rise-time, a fall-time and a peak voltage, the piezoelectric element moving the corresponding movable wall to generate a pressure wave in the ink in a corresponding one of the pressure chambers, and a drive circuit for controlling at least the rise-time and the peak voltage to allow the ink nozzle to generate ink droplets having different diameters.

The present invention also provides a method for driving a ink jet recording head having a plurality of pressure chambers each for receiving therein ink, each of the pressure chambers having a movable wall and a fundamental period of the ink in the pressure chamber, a piezoelectric element disposed in association with each the movable wall for responding to a drive pulse having a rise-time, a fall-time and a peak voltage, the piezoelectric element moving the corresponding movable wall to generate a pressure wave in the ink in a corresponding one of the pressure chambers, the method comprises the step of controlling at least the rise-time and the peak voltage to allow the ink nozzle to generate ink droplets having different diameters.

In accordance with the present invention, ink droplets having different diameters can be ejected from the ink nozzle by controlling the rise-time and the peak voltage of the drive pulse for the piezoelectric element while maintaining a constant velocity of the ink droplets, which achieves a high-speed printing as well as a high-quality printing.

The above and other objects, features and advantages of the present invention will be more apparent from the following description, referring to the accompanying drawings.

PREFERRED EMBODIMENTS OF THE INVENTION

In a preferred embodiment of the present invention, if waveform (drive voltage waveform) of the drive pulse has a rise-time (tu) which is between half the fundamental period (T) of the ink in the ink passage (or pressure chamber) and the fundamental period T (i.e., $T/2 \leqq tu \leqq T$), the pulse duration (tw) defined between the start of the rise-time (tu) and the start of the fall-time (td) is set at the fundamental period (T), and the peak voltage Vp of the drive voltage waveform is determined as $Vp=tu \times V0/t0$, wherein t0 and V0 are such that a suitable speed can be obtained by a specific peak voltage V0 with a rise-time of t0, which is equal to T/2, for a specific diameter of the ink droplet. In short, the peak voltage is controlled so that the peak voltage Vp is proportional to the rise-time tu for different diameters of the ink droplets.

If the rise-time tu is determined as $0 \leqq tu \leqq T/2$, the pulse duration tw is set at the fundamental period T, and the peak voltage Vp is determined as:

$$Vp=2\times tu\times V0/T\times\sin(\pi\times tu/T),$$

wherein V0 is determined such that a suitable velocity can be obtained by a specific peak voltage V0 with a rise-time equal to T/2.

If the rise-time tu is determined as $T \leqq tu$, the pulse duration tw is set at an integral multiple of the fundamental period T, and the peak voltage Vp is determined such that Vp/tu is equal to V0/t0 wherein a peak voltage V0 is obtained at t0 during the rise-time.

In the above conditions, the fall-time td of the drive voltage waveform is determined equal to the rise-time tu or longer, to form a trapezoid or triangle of the overall drive waveform. A desired diameter of the ink droplet can be obtained by controlling the rise-time tu and the peak voltage Vp without involving variations in the velocity of the ejected ink droplets.

Now, the present invention is more specifically described with reference to accompanying drawings.

Figure 1:
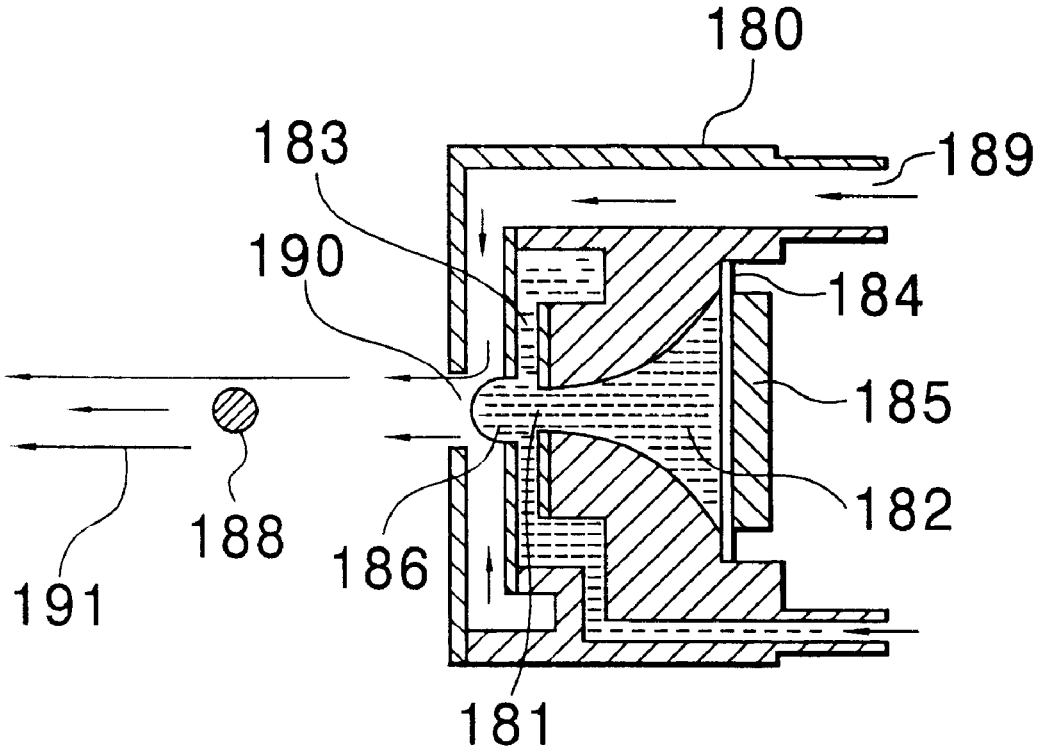
FIG. 1 PRIOR ART
FIG. 1 is a sectional view of a conventional ink jet recording head.
Figure 2A:
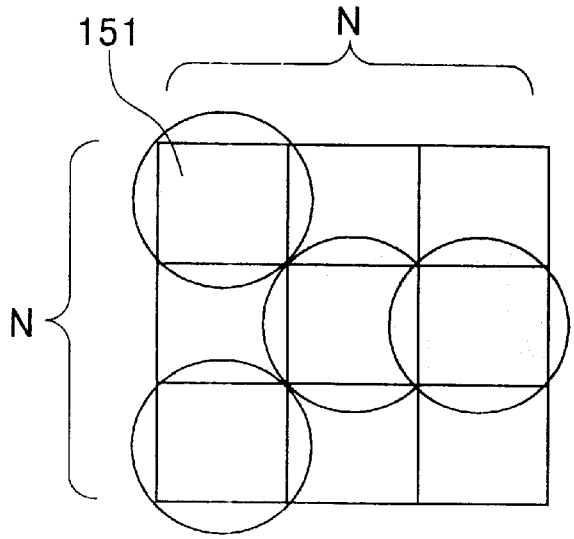
FIG. 2A PRIOR ART
FIGS. 2A and 2B are schematic views of N×N matrix dot patterns.
Figure 2B:
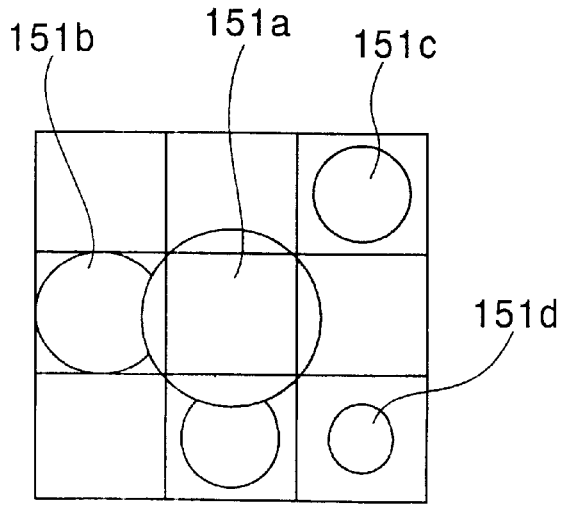
FIG. 2B PRIOR ART
Figure 3:
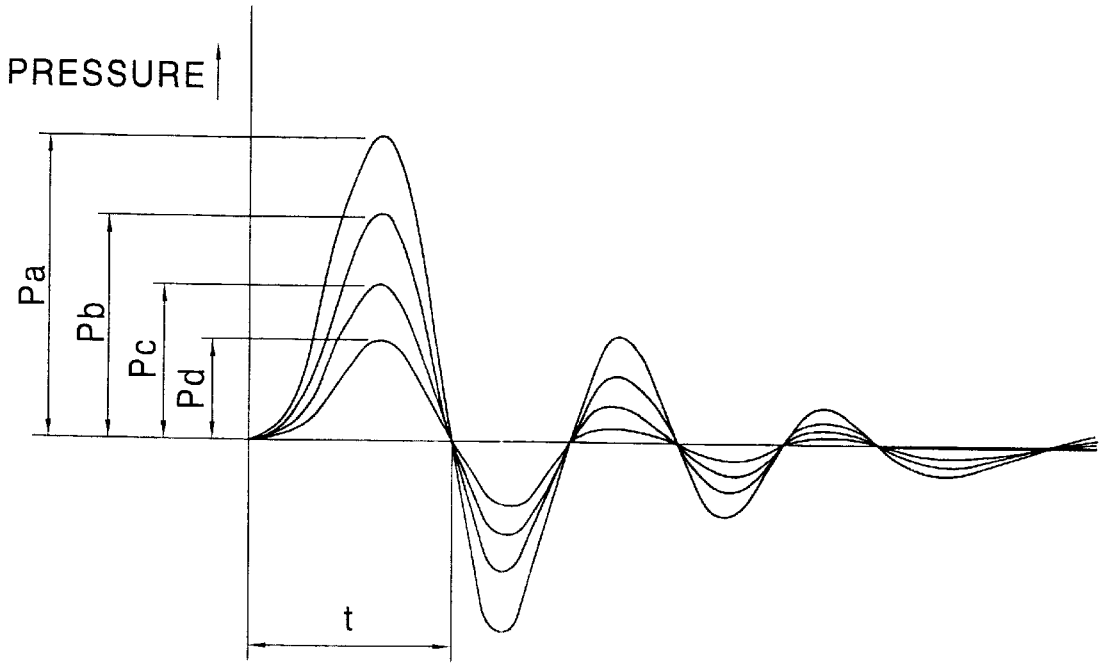
FIG. 3 PRIOR ART
FIG. 3 is a timing chart of pressure waveforms of ink in an ink passage.
Figure 4A:
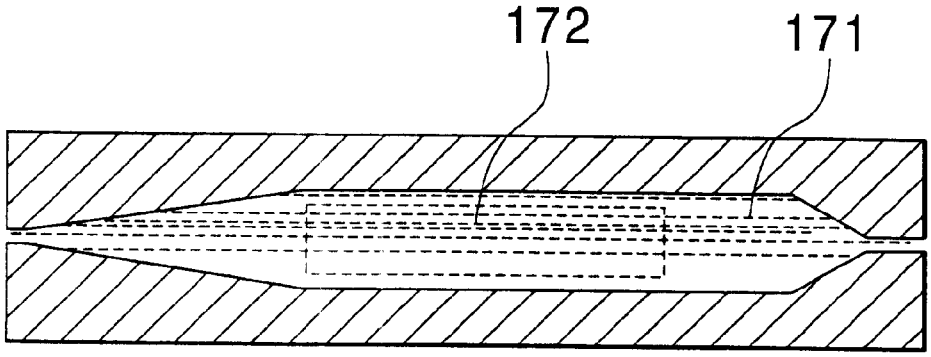
FIG. 4A PRIOR ART
FIG. 4A is a longitudinal-sectional view of an ink passage.
Figure 4B:
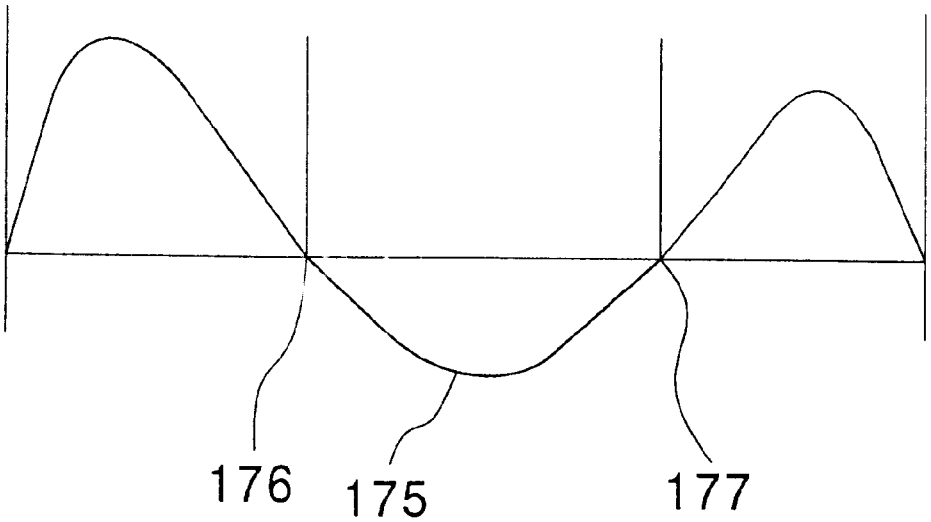
FIG. 4B PRIOR ART
FIG. 4B is a graph for showing one of the waves of natural oscillation modes of ink in the ink passage of FIG. 4A.
Figure 5:
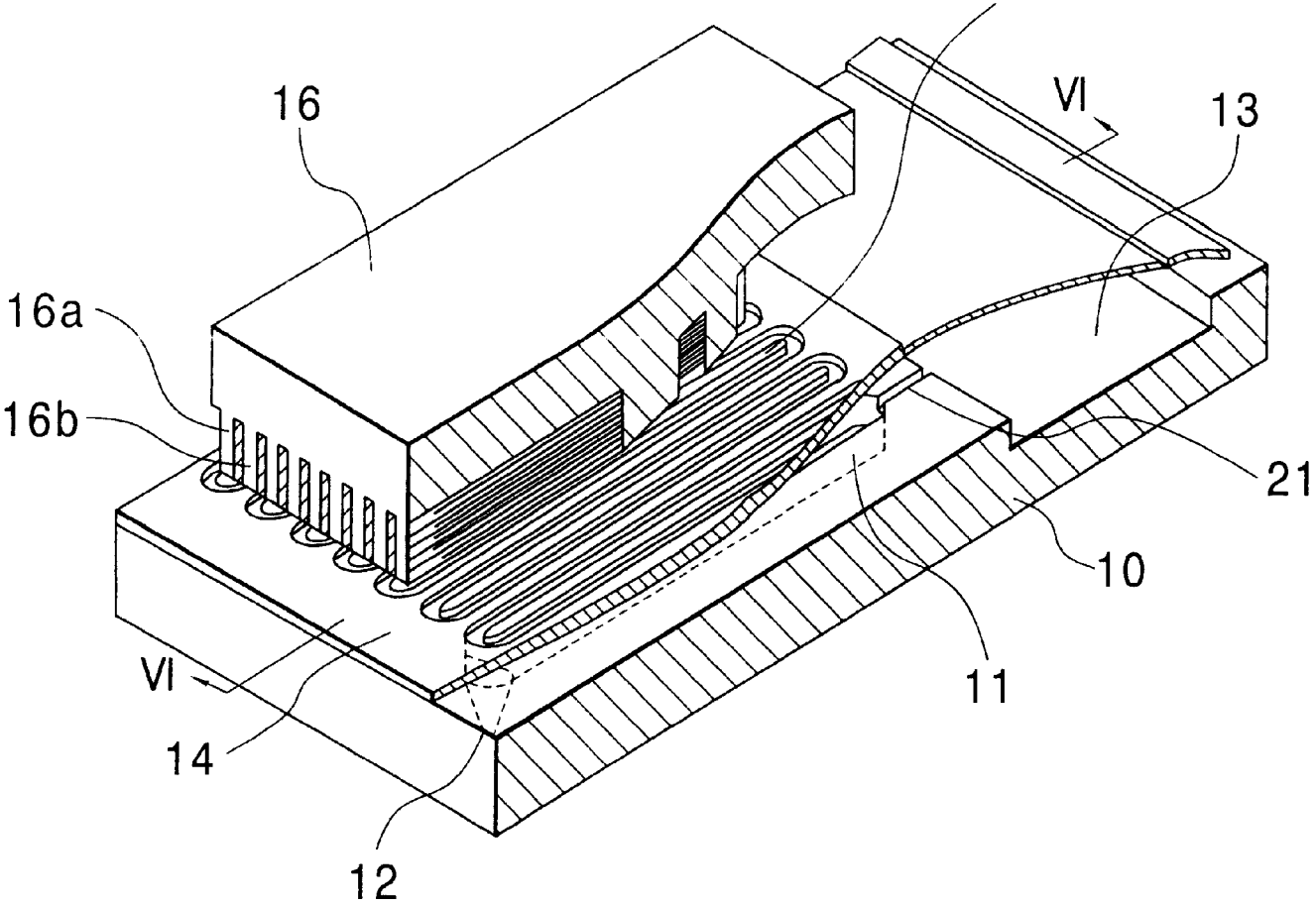
FIG. 5 is a partially-broken perspective view of an ink jet recording head according to an embodiment of the present invention.

Referring to FIG. 5, an ink jet recording head, generally designated by 100, according to an embodiment of the present invention includes a bottom plate 10, a plurality of pressure chambers 11 extending in the longitudinal direction of the ink jet recording head and each having side walls and a bottom wall defined by the bottom plate 10, and an elastic plate 14 adhered to the bottom plate 10 for covering the pressure chambers 11.

The elastic plate 14 has a movable wall 15 at the top of each pressure chamber 11. Each pressure chamber 11 has an ink nozzle 12 at the bottom thereof in the vicinity of the front end of the each pressure chamber 11, and an ink inlet port 32 formed in the rear wall of the pressure chamber and communicated with an ink reservoir 13 formed at the rear side of the bottom plate 10. A piezoelectric element 16 is provided on the top of the elastic plate 14.

The piezoelectric element 16 has a plurality of movable blades 16*a* and a plurality of support blades 16*b* separated by cut-out grooves (shown by hatching in the figure) and alternately disposed with each other. The movable blade 16*a* is bonded to a corresponding movable wall 15 of the elastic plate 14. The support blade 16*b* is boned to the stationary portion of the elastic plate 14 at the space between adjacent movable walls 15.

In the above configuration, when the movable blade 16*a* of the piezoelectric element 16 is impressed with a drive voltage, the movable blade 16*a* expands toward the bottom plate 10 to deform the movable wall 15, which protrudes in the pressure chamber 11 to raise the pressure in the pressure chamber 11.

The support blades 16*b* are provided to limit the movement of the elastic plate 14, whereby only the movable walls 15 of the elastic plate 14 expand downward and the overall structure of the recording head 100 including the bottom plate 10 and the remaining portions of the elastic plate 14 is not affected by the deformation of the movable blades 16*a*. The support blade 16*b* thus prevents the nozzles 12 adjacent to the driven nozzle 12 from ejecting ink droplets, thereby removing the cross talk between the nozzles 12. The cross talk can be also removed by a configuration such as proposed in JP-A-9-174837.

Figure 6A:
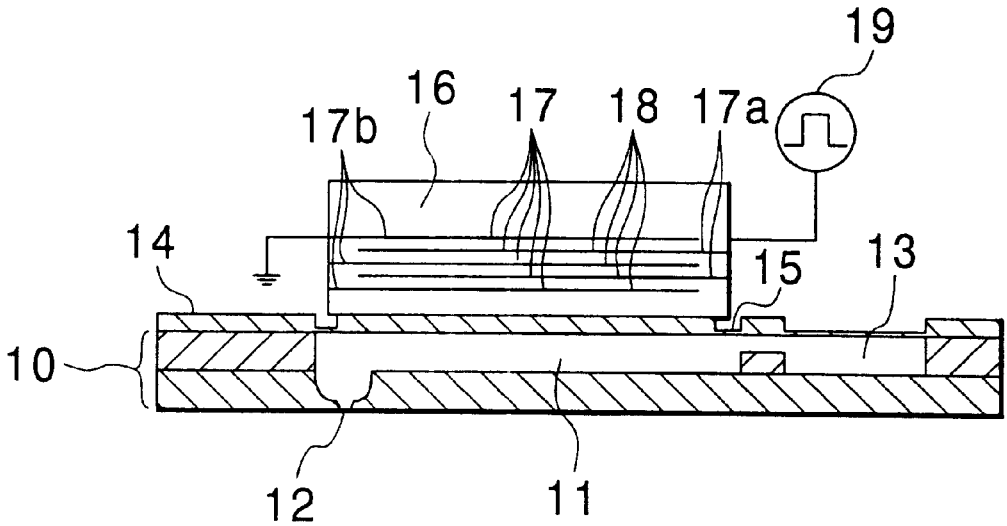
FIGS. 6A and 6B are longitudinal-sectional views of the recording head taken along line VI—VI in FIG. 5 for showing the operation of the movable wall.
Figure 6B:
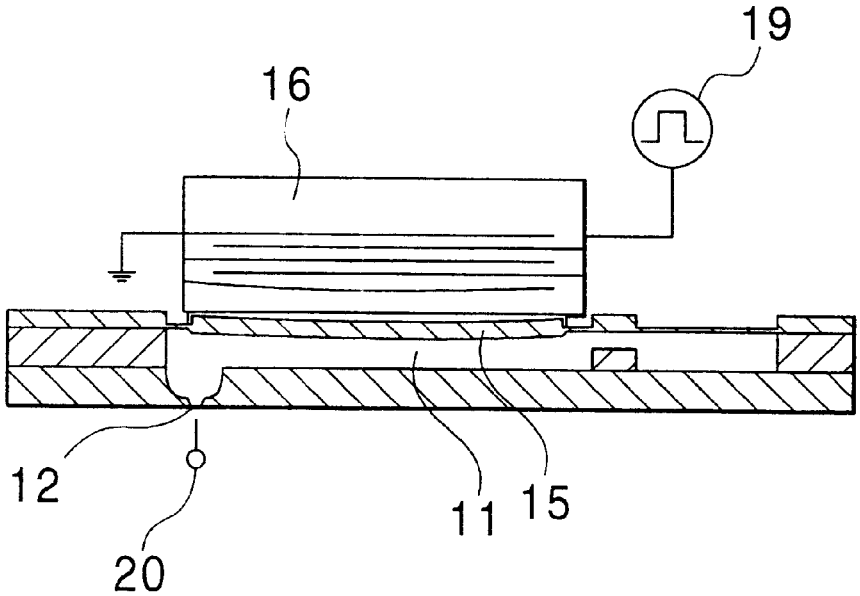

Referring to FIGS. 6A and 6B, there are shown states of one of the pressure chambers 11 and an associated movable blade 16*a* of the piezoelectric element 16. FIG. 6A shows a stationary state wherein no drive voltage is applied, whereas FIG. 6B shows a state wherein the movable blade 16*a* is driven by a drive pulse supplied from the drive circuit 19. The piezoelectric element 16 includes a pair of first and second comb-shaped electrodes 17*a* and 17*b* each including a plurality of electrode layers in each of the movable blades 16*a* and the support blades 16*b*, with a corresponding pair of layers 17 and 17*b* opposed to each other. The piezoelectric element 16 has also a plurality of piezoelectric layers 18 each sandwiched between a corresponding pair of opposed electrode layers 17*a* and 17*b*. Each piezoelectric layer 18 has a thickness of tens of micrometers, for example. The first electrode 17*a* of the movable blade 16*a* is applied with a drive voltage by the drive circuit 19, whereas the second electrode 17*b* is grounded. On the other hand, the electrodes of the support blade 16*b* are isolated from outside. The specified configuration of the piezoelectric element 16 allows an effective displacement of the movable blades 16*a* when applied with a relatively low voltage as low as tens of volts, with the support blades 16*b* maintained at a stationary state.

When a drive voltage is applied from the drive circuit 19, the piezoelectric element 16 is deformed, whereby the movable wall 15 is warped to protrude downward inside the pressure chamber 11 by the thrust force of the movable blade 16*a*, as shown in FIG. 6B. As a result, a pressure wave is generated in the ink in the ink chamber 11. The pressure wave in the ink is transferred to the ink nozzle 12, which ejects an ink droplet 20 therefrom.

Figure 7:
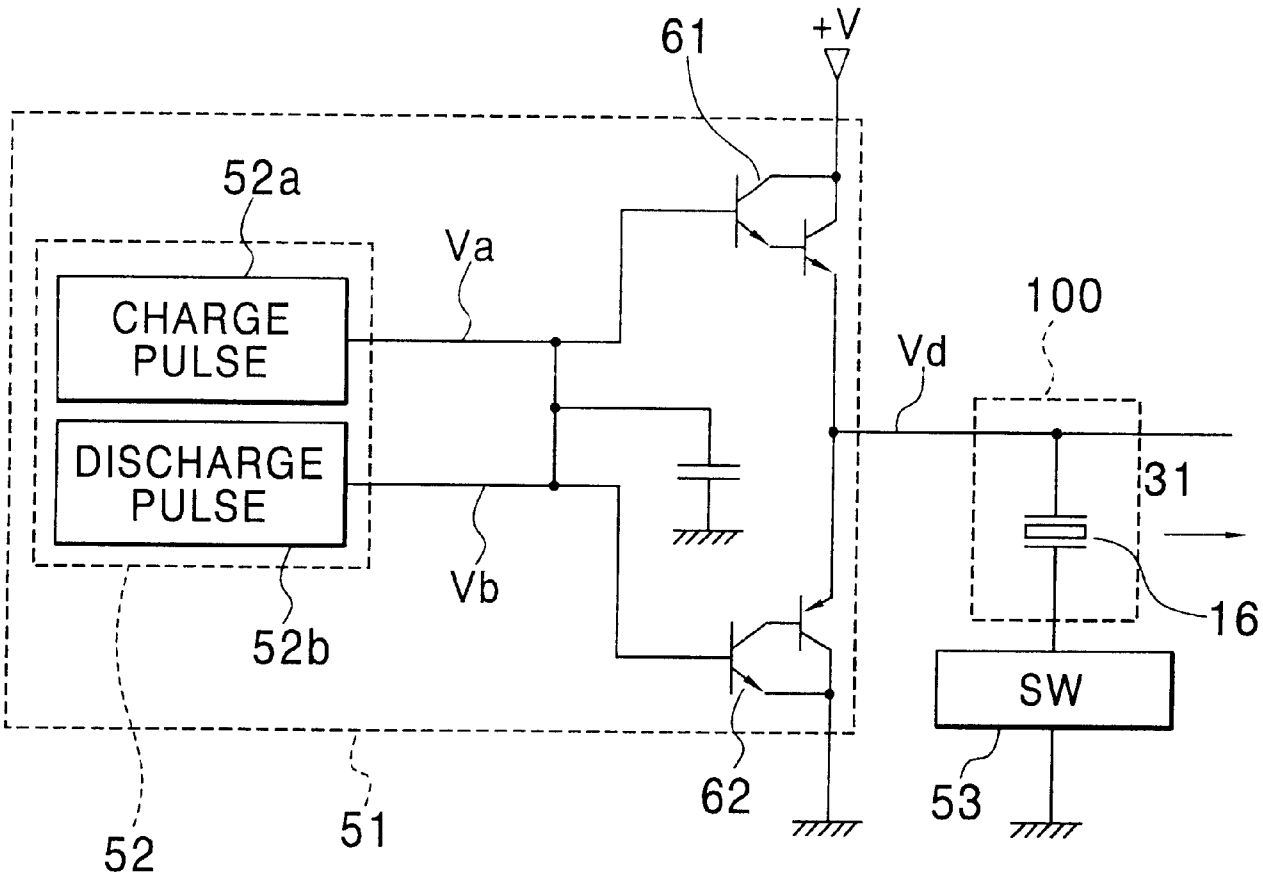
FIG. 7 is a circuit diagram of the drive circuit for the ink jet recording head of FIG. 5.

Referring to FIG. 7, the drive circuit 19 disposed for the ink jet recording head 100 includes a common circuit section 51 for impressing a drive voltage Vd to a common line connected to all the movable blades 16*a* and a switch 53 disposed for a corresponding one of the movable blades 16*a*. The switch 53 connects the corresponding movable blade 16*a* to the ground for impressing the drive voltage to the corresponding movable blade 16*a*, thereby applying an impulse wave 31 to the pressure chamber 11.

The common circuit section 51 includes a signal generator 52 including a charge pulse section 52*a* for generating a charge pulse Va and a discharge pulse section 52*b* for generating a discharge pulse Vb, a pair of cascaded NPN transistors 61 which are turned on by the charge pulse Va for charging the common line to a source voltage +V, and a pair of cascaded NPN transistors 62 which are turned on by the discharge pulse Vb for discharging the common line to the ground potential.

Figure 8:
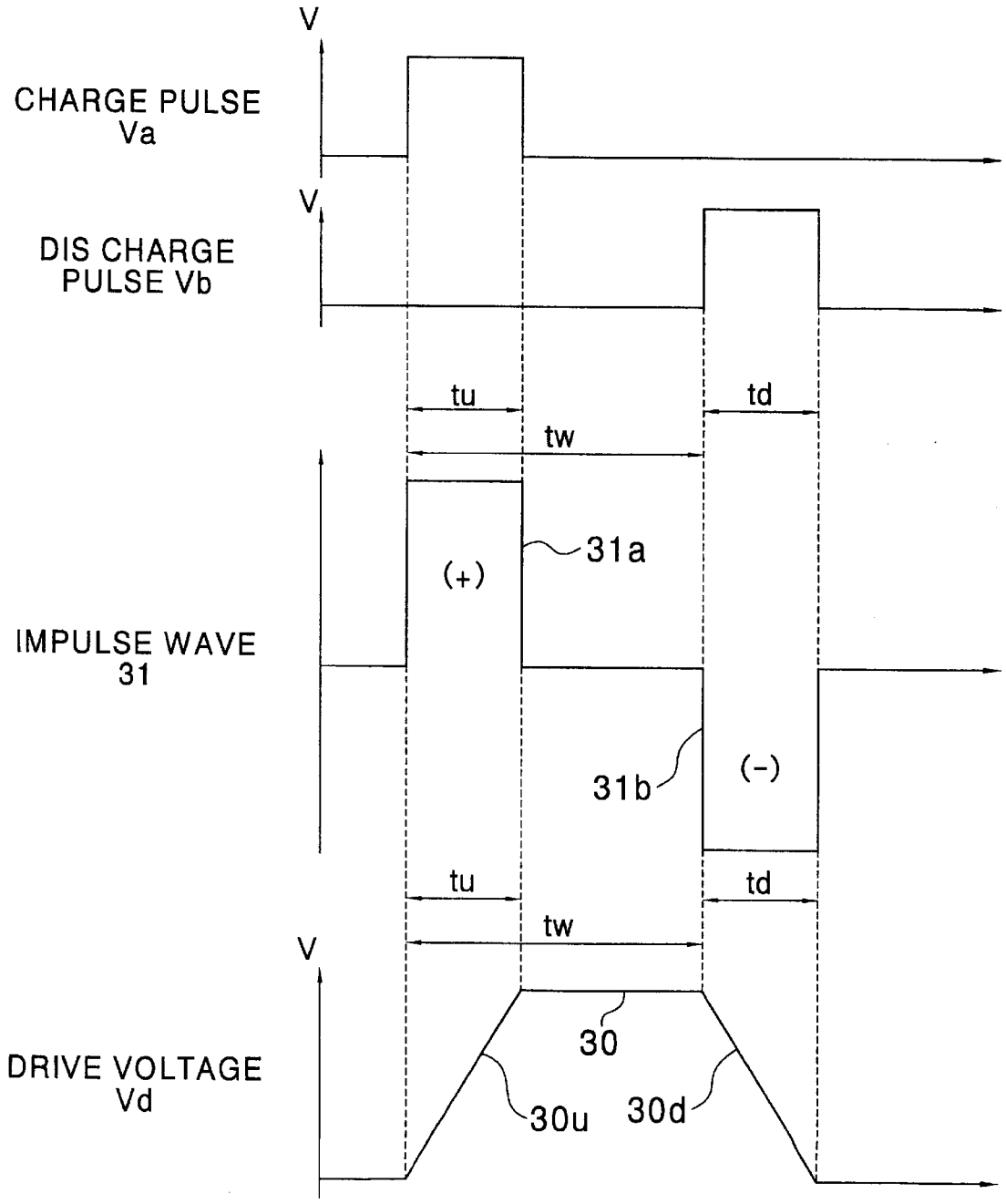
FIG. 8 is a timing chart of signal waveforms in the ink jet recording head of FIG. 5.

Referring to FIG. 8, after the switch circuits 53 latch the input print dot data, a charge pulse Va having a first duration tu is supplied from the charge pulse section 52*a* to the cascaded transistors 61. Thus, the cascaded transistors 61 charges the common line (Vd) up to the source potential +V during the first duration (rise-time) tu to deform the desired movable blade 16*a*, thereby applying an impulse wave 31.

After a second duration tw (tw>tu) elapsed since the start of the charge pulse Va, the discharge section 52*b* supplies a discharge pulse Vb having a third duration td to the cascaded transistors 62, to discharge the common line (Vd) down to the ground potential during the fall-time td. Thus, by controlling the timing of the charge pulse Va and the discharge pulse Vb, a desired waveform of the drive pulse Vd can be obtained as shown in FIG. 8, the drive pulse Vd including a rising edge 30*u*, a platform 30 and a falling edge 30*d*. Since the response time of the piezoelectric element is small and negligible, the waveform of the drive pulse Vd can be regarded as the deformation or displacement itself of the movable wall 15 shown in FIG. 6B.

The magnitude of the pressure in the pressure chamber 11 and the ink ejection velocity can be determined by the slope of the rising edge 30*u* and the falling edge 30*d* of the drive voltage Vd or the deformation velocity of the movable wall 15.

Assuming that the drive voltage Vd has a uniform slope at the rising edge 30*u* and the falling edge 30*d*, the impulse wave 31 includes rectangular pulses 31*a* and 31*b* having first duration (equal to rise-time) tu and the third duration (equal to fall-time) td, respectively.

The velocity response v of the nozzle receiving the rectangular pulses 31*a* and 31*b* are as follows. The waveform ξ (t) of the rectangular pulses can be expressed by:

$$\xi(t)=\xi u, \text{ for a time interval } t\text{: } 0\leqq t\leqq t \tag{6}$$

$$\xi(t)=0, \text{ for a time interval } t\text{: } tu\leqq t\leqq tw) \tag{7}$$

$$\xi(t)=\xi d, \text{ for a time interval } t\text{: } tw\leqq t\leqq tw+td \tag{8}$$

$$\xi(t)=0, \text{ for a time interval } t\text{: } tw+td\leqq t) \tag{9}$$

wherein ξu and ξd are the maximum values of the pulse.

The velocity response v(t) can be expressed as follows:

$$v1(t)=\alpha\times\xi u\times(1-\cos\omega_n t) \text{ for } 0\leqq t\leqq tu \tag{10}$$

$$v2(t)=\alpha\times\xi u\times\{2\sin(\pi tu/T)\}\times\sin\omega_n(t-tu/2)$$

$$\text{for } 0\leqq t\leqq tw \tag{11}$$

$$v3(t)=v2(t)+\alpha\times\xi d\times(1-\cos\omega_n t)$$

$$\text{for } 0\leqq t\leqq td \tag{12}$$

$$v4(t)=v2(t)+\alpha\times\xi d\{2\sin(\pi td/T)\}\times\sin\omega_n(t-tw-td/2)$$

$$\text{for } tw+td\leqq t \tag{13}$$

wherein α represents a coefficient for converting the peaks of the rectangular pulses 31*a* and 31*b* into the ink velocity v(t), and can be determined based on the ink density, volume modulus and shape and dimensions of the pressure chamber, whereas $\omega_n$ represents natural angular frequency and is expressed by 2 π/T where T is the fundamental period of the ink in the pressure chamber.

Figure 9:
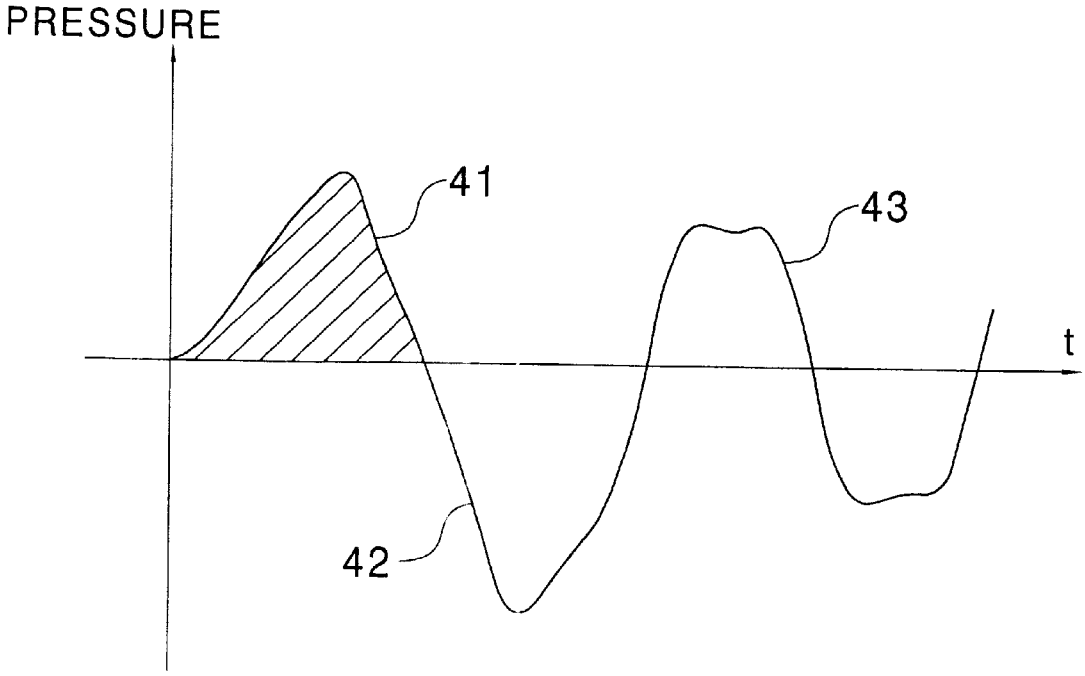
FIG. 9 is timing chart of a pressure wave in the ink jet recording head of FIG. 5.
Figure 10A:
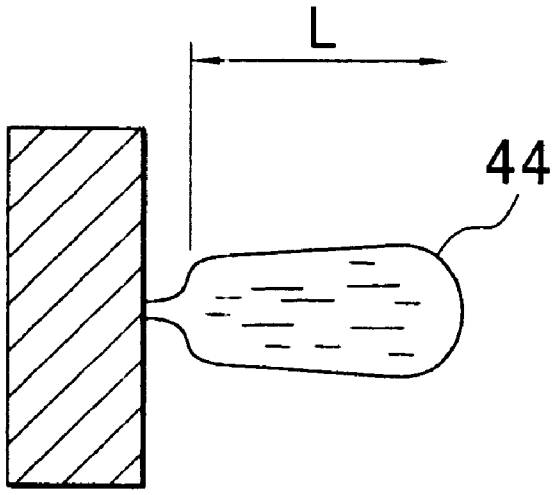
FIGS. 10A and 10B are partial side views of the ink jet recording head of FIG. 5 for showing ink ejection.

Referring to FIG. 9, there is shown a timing chart of the pressure wave which corresponds to the velocity response characteristic of the ink at the nozzle 12. The hatched area, obtained by integration of the first positive pressure wave 41 (or integration of the velocity response curve 41), corresponds to the length L1 of an elongate ink droplet, such as 44 shown in FIG. 10A, which is just ejected from the nozzle. The elongate ink droplet 44 is separated from the succeeding ink droplet due to the presence of the succeeding negative pressure wave 42. The elongate ink droplet 44 has a volume calculated by multiplying the hatched area in FIG. 9 by the sectional area of the nozzle. The elongate ink droplet 44 is formed as a spherical main ink droplet 45 after the ejection, as shown in FIG. 10B.

Figure 10B:
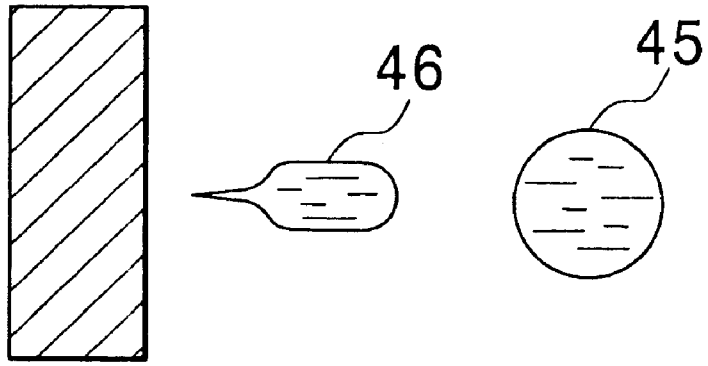

A satellite ink droplet 46 is further ejected following the main ink droplet 45 due to the succeeding positive wave 43 in FIG. 9 generated by the residual vibration, as shown in FIG. 10B.

The satellite ink droplet 46 has a lower velocity compared to the main ink droplet 45, thereby degrading the image quality of the ink jet recording head. Thus, the residual vibration should be removed or controlled for improving the image quality.

To control the residual vibration of the ink after impressing the drive voltage, it is noted from equation (13) that rise-time tu, fall-time td and pulse duration tw of the drive voltage waveform should satisfy the following equation:

$$v4(t)=0 \tag{14}$$

Assuming that rise-time tu and fall-time td are equal, which results in ξu=−ξd, the following relationship:

$$\sin\omega_n(t-tu/2)=\sin\omega_n(t-tw-tu/2) \tag{15}$$

can be obtained from equations (13) and (14).

Further, from equation (15), utilizing the nature of the sine function, the following relationship:

$$tw=n\times T$$

can be obtained where n=1, 2, 3, . . . This means that the residual vibration can be suppressed when the rise-time tu is equal to the fall-time td and the pulse duration tw is an integral multiple of the natural vibration period (fundamental period) T of the ink in the pressure chamber 11.

In a practical configuration, considering that the velocity response of ink to the pressure wave exhibits attenuation due to viscosity of the ink, the equality of the rise-time tu and the fall-time td may be modified so that the fall-time td is slightly longer than the rise-time tu.

The volume of the ink droplet can be controlled by changing the rise-time tu and the fall-time td of the drive voltage waveform under the condition as described above. The volume of the ink droplet is approximately equal to the product of the maximum displacement of the movable wall by the sectional area of the nozzle, the displacement being obtained by integration of the velocity of the ink droplet just ejected from the nozzle with respect to time (see journal of ELECTROPHOTOGRAPHIC INSTITUTE, 1987, March vol. 26-1, pp2–10, for example). A larger volume for the ink droplet can be obtained by a larger rise-time tu of the drive voltage in equation (10) compared to the fundamental period T of the ink.

Figure 11A:
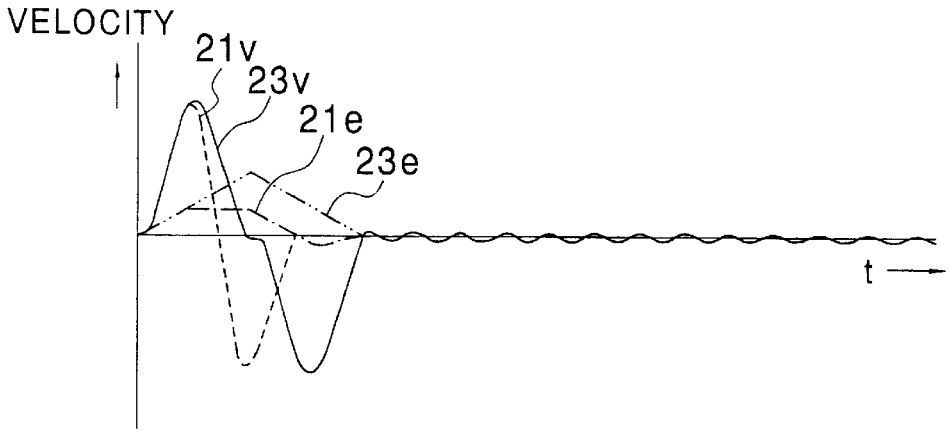
FIGS. 11A, 11B and 11C are timing charts of velocity response of the ink to the drive voltage waveform, obtained by simulations for the inkjet recording head of FIG. 5.
Figure 11B:
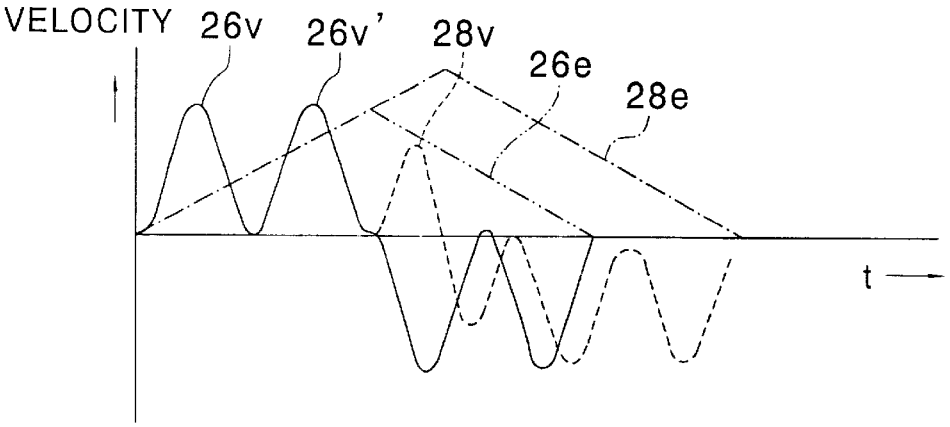
Figure 11C:
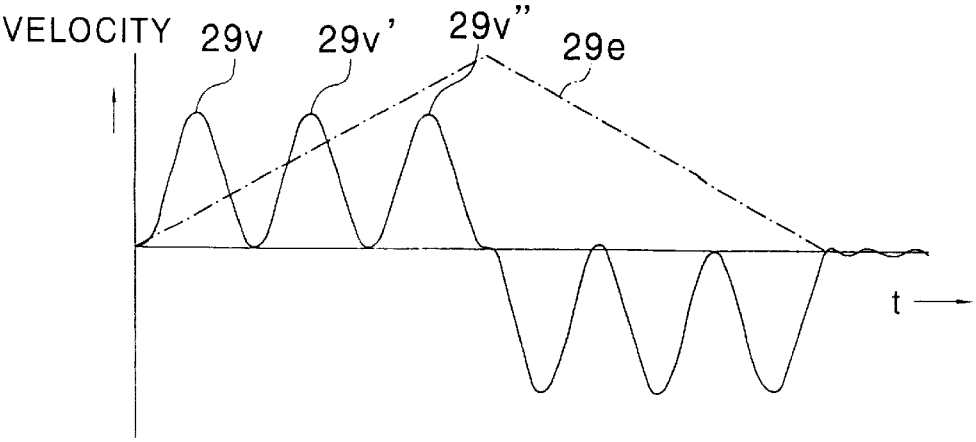

FIGS. 11A, 11B and 11C show results of simulation of the velocity response of the ink to the drive voltage waveform for the ink jet recording head according to the embodiment. FIG. 8 shows the practical examples of the drive voltage waveform, which were used for the simulations. A finite element method is used in the simulations.

The waveforms 21*e* and 22*e* are of a trapezoid due to a smaller rise-time tu compared to the fundamental period T, whereas the waveform 23*e* is of a triangle due to the coincidence of the pulse duration tw with the fundamental period T and an equality of rise-time tu with the fundamental period T.

The simulations for the case, wherein drive voltage waveforms 21*e* and 23*e* were applied to the piezoelectric element, revealed velocity responses 21*v* and 23*v* shown in FIG. 11A. The rise-time tu in waveform 21*e*, which is smaller than half the fundamental period T, presented a peak of velocity response 21*v* which is smaller than the peak of velocity response 23*v* when the slope of waveform 21*e* is equal to the slope of waveform 23*e*. Thus, a larger slope in the rise-time tu of waveform 21*e* should be employed to correct the peak voltage Vp so that the peak of velocity response 21*e* is equal to the peak of velocity response 23*e*. The correction can be expressed based on equation (11) as follows:

$$Vp=(2V0\times tu/T)/\sin \pi tu/T \quad (17)$$

wherein V0 represents a peak voltage when the drive voltage waveform has a rise-time tu=T/2. Under this condition, the ink velocity is at a maximum and called a basic velocity.

Corrected velocity response 21*v* provided by the corrected drive voltage waveform 21*e* has a smaller wavelength compared to velocity response 23*v* and thus provides a smaller volume for the ink droplet. On the other hand, the peak of velocity response 21*v* is equal to the peak of velocity response 23*v*, which means a smaller volume can be obtained without reducing the ink velocity.

Figure 12:
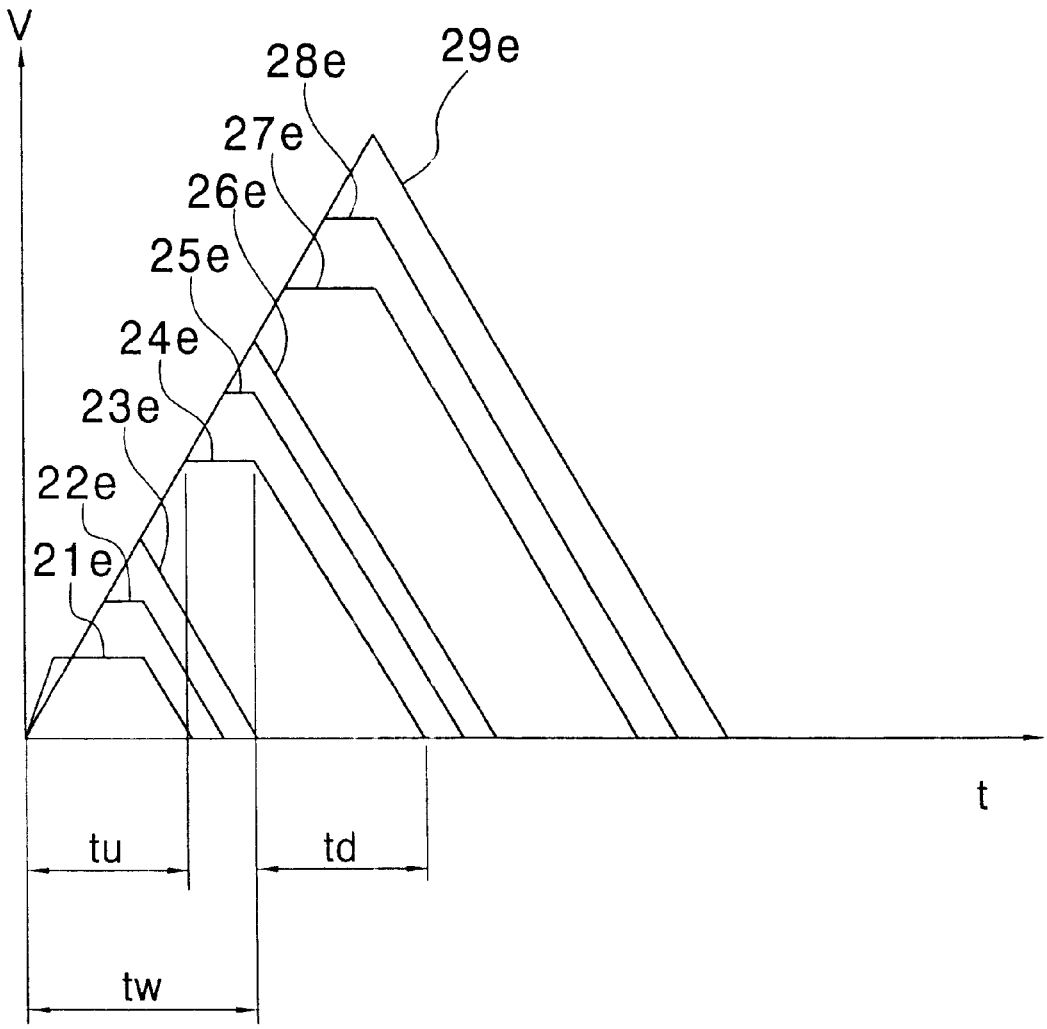
FIG. 12 is a timing chart of drive voltage waveforms in the ink jet recording head of FIG. 5.

In FIG. 12, drive voltage waveform 24*e*, 25*e* and 26*e* have rise-times tu which are larger than the fundamental period T. Thus, the pulse widths tw are set at a value which is double the fundamental period T based on equation (16).

On the other hand, drive voltage waveforms 27*e*, 28*e* and 29*e* have rise-times tu which are larger than double the fundamental period T. Thus, the pulse widths tw are set at a value equal to twice the fundamental period T.

The simulations for drive voltage waveforms 26*e* and 28*e* are shown in FIG. 11B. The drive voltage waveform 26*e* having a rise-time tu equal to double the fundamental period T provided a first velocity wave 26*v* and a second velocity wave 26*v'*.

Figure 13A:
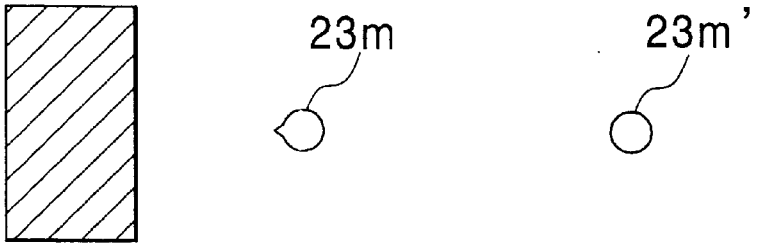
FIGS. 13A, 13B and 13C are partial side views of the ink jet recording head of FIG. 5 for showing ink ejection.
Figure 13B:
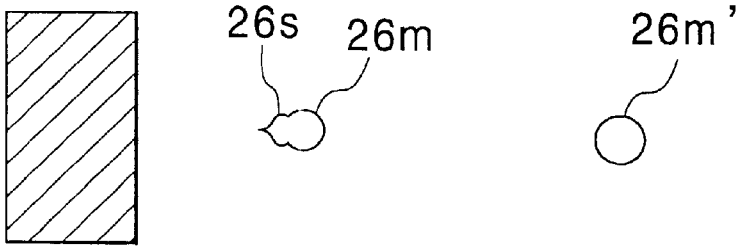
Figure 13C:
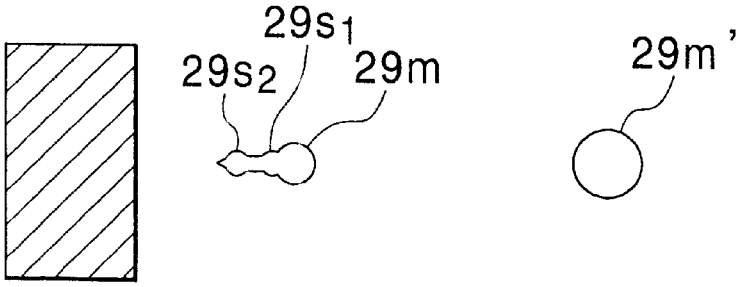

FIGS. 13A, 13B and 13C show the ink droplets ejected by the drive voltage waveforms 23*e*, 26*e* and 29*e*, respectively. In FIG. 13B, the first wave 26 and the second wave 26*v'* ejected a main droplet 26*m* and an accompanying droplet 26*s*, respectively, which are coupled together to form a single droplet 26*m'* by a surface tension. The coupled droplet 26*m'* has a larger volume compared to the droplet 23*m'* shown in FIG. 13A.

The drive voltage waveform 29*e* having a rise-time tu larger than double the fundamental period T provides a third wave 29*v"* in addition to the first and second waves 29*v* and 29*v'*, as shown in FIG. 11C. The time intervals between the first wave and the third wave is extremely small compared to the velocity of the droplets. These waves eject a main droplet 29*m*, a first accompanying droplet 29*s*2 and a second accompanying droplet 29*s*2, as shown in FIG. 13C. Although the velocity of the second accompanying droplet 29*s*2 is smaller compared to those of the main droplet 29*m* and the first accompanying droplet 29*s*1, these three droplets are coupled together by a surface tension to form a larger single droplet 29*m'*.

In the present embodiment, there is an advantage in that a larger maximum size of the ink droplet does not involve a reduced printing velocity. In contrast, in the conventional recording head, a larger ink droplet is obtained by a larger wavelength for a single pressure wave, which required a larger fundamental period T and thus necessitated a longer ink passage.

More specifically, for example, after the ink droplet 20 is ejected from a nozzle 12 in FIG. 6B, the ink in the pressure chamber 11 for the nozzle 12 is consumed. Thus, the consumed amount of ink is then replenished from the ink reservoir 13 through the pressure chamber 11 to the nozzle due to the surface tension of the ink meniscus in the nozzle 12 and a capillary function.

If the pressure chamber 11 has a larger length, the ink replenishment takes a long time due to a larger resistance in the pressure chamber 11 resulting from the viscosity of the ink. In contrast, in the present embodiment, the maximum diameter of the ink droplet depends on the displacement of the piezoelectric element irrespective of the length of the pressure chamber. Thus, a large ink droplet can be ejected from a pressure chamber having a smaller length.

The smaller length of the pressure chamber reduces the viscose resistance of the ink, and accelerates the ink replenishment after the ink ejection. As a result, a repetitive frequency for the ink ejection can be improved in the present embodiment to achieve a higher-speed printing compared to the conventional recording head.

Figure 14:
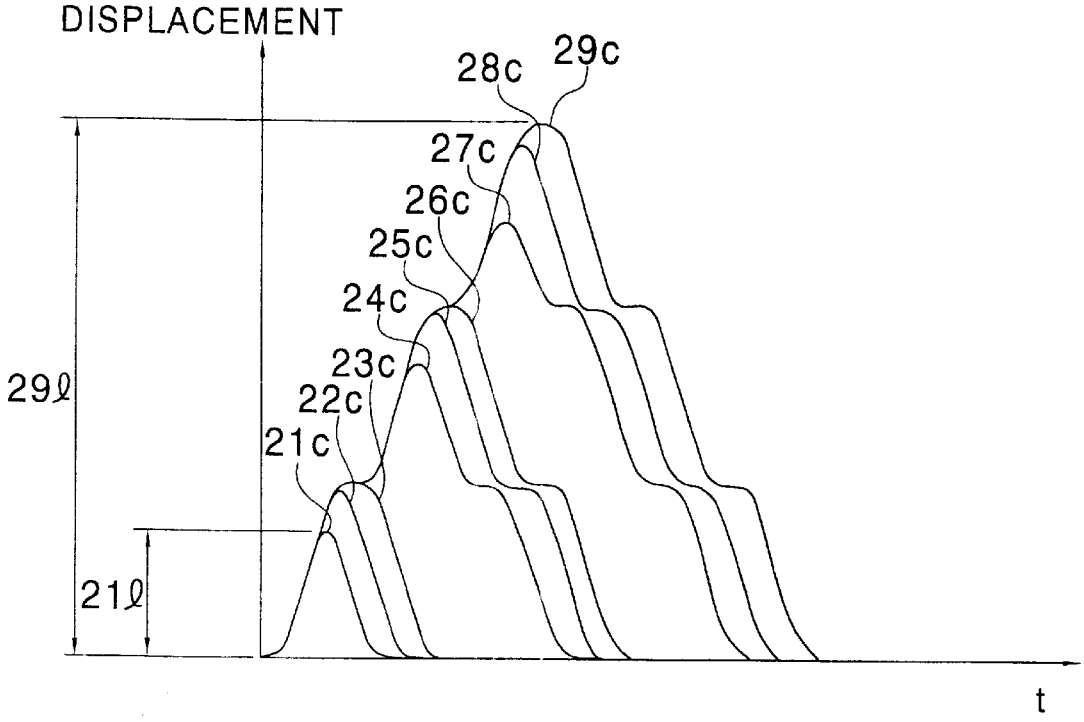
FIG. 14 is a schematic chart for showing the relationship between displacements of the movable blade and lengths of elongate ink droplets in the ink jet recording head of FIG. 5.

Referring to FIG. 14, there is shown length of the elongate ink droplet responding to the drive voltage. FIG. 14 can be obtained by integration of the waveforms of velocity shown in FIGS. 11A, 11B and 11C with respect to time, thereby showing the lengths L of the elongate ink droplets (just after ejected from the nozzle) which correspond to the displacements based on the drive voltages 21*e* to 29*e* shown in FIG. 12.

The products of the maximum values 21L to 29L for the respective response waveforms 21*c* to 29*c* by the sectional area of the nozzle correspond to the volumes of the ink droplets. If the maximum voltage for the piezoelectric element is obtained by the drive voltage waveform 29*e* due to the limit by the source voltage, the maximum length of the elongate ink droplet is 29L. On the other hand, if the minimum voltage is provided by the drive voltage waveform due to the characteristics of the piezoelectric element, the minimum length of the elongate ink droplet is 21L.

Figure 15:
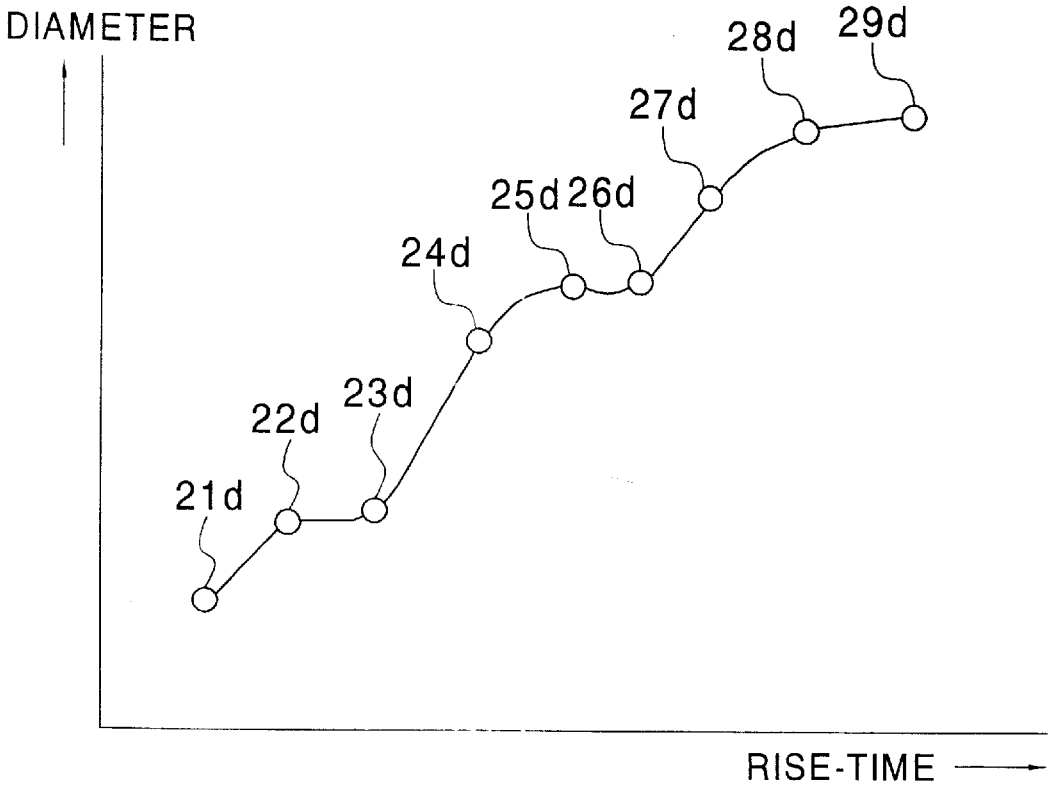
FIG. 15 is a graph showing rise-time dependency of diameter of the ink droplet.

Referring to FIG. 15, there is shown rise-time dependency of the diameter of ink droplet. The diameters 21*d* to 29*d* are obtained by multiplying the maximum values of the response curves of FIG. 10 by the sectional area of the nozzle, correcting the obtained values into diameters of the ink droplets, and plotting the same with respect to the rise-times tu of the respective drive voltage waveforms 21*e* to 29*e*.

If the rise-time in the drive voltage waveform resides in the vicinity of integral multiples of the fundamental period T, the increase of the displacement for the ink ejection is lowered in the vicinity, as shown at the portions in the vicinities of 23*d*, 26*d* and 29*d* in the curve of FIG. 11, corresponding to the drive voltage waveforms 23*e*, 26*e* and 29*e*.

Although the obtained results, as shown in FIG. 12, do not exhibit a linear relationship between the dot diameter and the rise-time, the dot diameter can be controlled substantially linearly by retrieving the correcting factor for the rise-time based on the input data from a table.

The present invention can be applied, in addition to the piezoelectric element having a laminate structure as described above, to an impulse ink jet recording head using a bimorph piezoelectric element and an impulse applied to the ink in the recording head.

The present invention can be also applied to an ink jet recording head using a lower concentration ink in addition to a normal ink to adapt to a gray scale printing using different concentrations of ink in combination with the minimum diameter droplet.

Since the above embodiments are described only for examples, the present invention is not limited to the above embodiments and various modifications or alterations can be easily made therefrom by those skilled in the art without departing from the scope of the present invention.

What is claimed is:

1. An ink jet recording head comprising:

a plurality of pressure chambers each for receiving therein ink, each of said pressure chambers having a movable wall and a fundamental period of the ink in said pressure chamber;

an ink nozzle disposed for each of said pressure chambers for ejecting the ink in said pressure chamber as an ink droplet;

an ink inlet port for receiving the ink to each of said pressure chambers;

a piezoelectric element disposed in association with each said movable wall for responding to a drive pulse having a rise-time, a fall-time and a peak voltage, said piezoelectric element moving said corresponding movable wall to generate a pressure wave in the ink in a corresponding one of said pressure chambers; and a drive circuit for controlling at least said rise-time and said peak voltage to allow said ink nozzle to generate ink droplets having different diameters, wherein said rise-time is above half said fundamental period, and a pulse duration between a start of said rise-time and a start of said fall-time is equal to said fundamental period.

2. The ink jet recording head as defined in claim 1, wherein said rise-time is below said fundamental period, and said peak voltage is proportional to said rise-time.

3. The ink jet recording head as defined in claim 2, wherein said rise-time is substantially equal to said fall-time.

4. The ink jet recording head as defined in claim 3, wherein said drive pulse is one of a trapezoid waveform and a triangle waveform, and a slope of said rise-time for an ink droplet having one diameter is equal to a slope of said rise-time for ink droplets having different diameters.

5. The ink jet recording head as defined in claim 1, wherein said rise-time is above said fundamental period, and is an integral multiple of said fundamental period.

6. The ink jet recording head as defined in claim 5, wherein said rise-time is substantially equal to said fall-time.

7. The ink jet recording head as defined in claim 6, wherein said drive pulse is one of a trapezoid waveform and a triangle waveform, and a slope of said rise-time for an ink droplet having one diameter is equal to a slope of said rise-time for ink droplets having different diameters.

8. An ink jet recording head comprising:

a plurality of pressure chambers each for receiving therein ink, each of said pressure chambers having a movable wall and a fundamental period of the ink in said pressure chamber;

an ink nozzle disposed for each of said pressure chambers for ejecting the ink in said pressure chamber as an ink droplet;

an ink inlet port for receiving the ink to each of said pressure chambers;

a piezoelectric element disposed in association with each said movable wall for responding to a drive pulse having a rise-time, a fall-time and a peak voltage, said piezoelectric element moving said corresponding movable wall to generate a pressure wave in the ink in a corresponding one of said pressure chambers; and a drive circuit for controlling at least said rise-time and said peak voltage to allow said ink nozzle to generate ink droplets having different diameters, wherein said rise-time is below half said fundamental period.

9. The ink jet recording head as defined in claim 8, wherein a pulse duration between a start of said rise-time and a start of aid fall-time is equal to said fundamental period.

10. The ink jet recording head as defined in claim 9, wherein said rise-time is substantially equal to said fall-time.

11. The ink jet recording head as defined in claim 10, wherein said drive pulse is one of a trapezoid waveform and a triangle waveform, and a slope of said rise-time for an ink droplet having one diameter is equal to a slope of said rise-time for ink droplets having different diameters.

12. A method for driving a ink jet recording head, comprising the steps of:

providing a plurality of pressure chambers each for receiving therein ink, each of said pressure chambers having a movable wall and a fundamental period of the ink in said pressure chamber, a piezoelectric element disposed in association with each said movable wall for responding to a drive pulse having a rise-time, a fall-time and a peak voltage, said piezoelectric element moving said corresponding movable wall to generate a pressure wave in the ink in a corresponding one of said pressure chambers; and controlling at least said rise-time and said peak voltage to allow said ink nozzle to generate ink droplets having different diameters, wherein said rise-time is above half said fundamental period, and a pulse duration between a start of said rise-time and a start of said fall-time is equal to said fundamental period.

13. The method as defined in claim 12, wherein said rise-time is below said fundamental period, and said peak voltage is proportional to said rise-time.

14. The method as defined in claim 12, wherein said rise-time is above said fundamental period, and is an integral multiple of said fundamental period.

15. The method as defined in claim 14, wherein said drive pulse is one of a trapezoid waveform and a triangle waveform, and a slope of said rise-time for an ink droplet having one diameter is equal to a slope of said rise-time for ink droplets having different diameters.

16. A method for driving a ink jet recording head, comprising the steps of:

providing a plurality of pressure chambers each for receiving therein ink, each of said pressure chambers having a movable wall and a fundamental period of the ink in said pressure chamber, a piezoelectric element disposed in association with each said movable wall for responding to a drive pulse having a rise-time, a fall-time and a peak voltage, said piezoelectric element moving said corresponding movable wall to generate a pressure wave in the ink in a corresponding one of said pressure chambers; and controlling at least said rise-time and said peak voltage to allow said ink nozzle to generate ink droplets having different diameters, wherein said rise-time is below half said fundamental period.

17. The method as defined claim 16, wherein said drive pulse is one of a trapezoid waveform and a triangle waveform, and a slope of said rise-time for an ink droplet having one diameter is equal to a slope of said rise-time for ink droplets having different diameters.

* * * * *